United States Patent [19]

Hilfiker

[11] 4,068,482

[45] Jan. 17, 1978

[54] RETAINING WALL STRUCTURE USING PRECAST STRETCHER SECTIONS

[75] Inventor: William K. Hilfiker, Eureka, Calif.

[73] Assignee: Hilfiker Pipe Company, Eureka, Calif.

[21] Appl. No.: 711,081

[22] Filed: Aug. 2, 1976

[51] Int. Cl.[2] ..... E02D 17/00

[52] U.S. Cl. ..... 61/47; 52/588

[58] Field of Search ..... 61/47, 49, 39, 35; 52/588, 542

[56] References Cited

U.S. PATENT DOCUMENTS

| | | | |
|---|---|---|---|
| 1,485,381 | 3/1924 | Evers | 61/47 |
| 1,819,026 | 8/1931 | Hobson | 61/47 |
| 2,828,613 | 4/1958 | Wilson | 61/47 |

*Primary Examiner*—Jacob Shapiro

[57] ABSTRACT

Precast stretchers in four basic configurations may be used to construct cribbing faces, end walls, and corners for virtually every retaining wall requirement. Each stretcher of the invention comprises an elongated body having two support heads with flat upper and lower surfaces for stacking the stetchers one on another. All the support heads are equally spaced and each head contains a vertical hole for receiving a steel tie rod that extends, in several threaded sections, from the footing to the top of the wall for tying together the stacked support heads and stretchers. Anchor rods for deadmen, bin wall anchorages, or rock bolts are connected to the vertical tie rods to form a rigid interlocked retaining structure.

15 Claims, 16 Drawing Figures

RETAINING WALL STRUCTURE USING PRECAST STRETCHER SECTIONS

BACKGROUND OF THE INVENTION

This invention relates to retaining walls and particularly to walls constructed of precast stretchers having four basic configurations that may be used to construct retaining wall faces, end walls and corners, all of which are interlocked together by vertical tie rods in each of the two support heads that are separated by a constant spacing on each stretcher.

The stretchers are comprised of suitably reinforced concrete. They have retaining bodies with generally elongated cross-sections which are cast together with the support heads. The principal stretcher that is used nearly exclusively for the front face of the retaining wall will be referred to as the "full stretcher" and is designed to be installed in staggered courses to form the wall. A somewhat similar stretcher and staggered courses are shown in U.S. Pat. No. 3,922,864, particularly in FIG. 5 thereof.

While staggered courses of stretchers provide rigidity and strength to the retaining structure, they are not particularly suited to the construction of end walls and to the corners between face walls and end walls. Therefore, the present invention provides not only the full stretchers for staggered base wall constructions, but also provides a stretcher, referred to as a "right-hand stretcher"that is approximately three-fourths the length of the full stretcher and connects between a course of full stretchers and the wall corner; a "one-half" and "one-third" stretcher that are approximately one-half the length of the full stretcher and which are used as building blocks to interconnect between end sections, corner sections, or other stretchers to provide the desired structure.

SUMMARY OF THE INVENTION

As previously noted, each stretcher, regardless of type or size, has two support heads. The heads in the full stretcher are the full height of the stretcher; that is, if the cross-section of the stretcher retaining body is an elongated octagon that is 8 inches wide by 24 inches high, all support heads on the full stretcher will be 24 inches high. However, on the stretchers designated as "right-hand," "one-third" and "one-half," the support head is located at the stretcher end and is only 12 inches high so that these "short heads" may be staggered within one course of stretchers and at the corner between the end walls and wall face as will be subsequently described in detail.

All stretchers have two support heads, each with a vertical hole for receiving a tie rod that is rigidly connected to the footing and extends to the top of the retaining wall. To simplify the construction and thereby reduce construction costs, each tie rod is made up of short coupled sections, thus obviating the need for hoisting each stretcher to the full height of the wall, threading the tie rod through the head holes, and finally lowering the stretcher on to the next lower course. The short tie rod sections are preferably a length equal to the height of three courses of stretchers which, in the preferred embodiment to be described, would be approximately 6 feet. The tie rods are, therefore, coupled to the wall footing at spacings that correspond to the spacing between the holes in the stretcher heads. Three courses of stretchers are then stacked on the footing, and additional sections of the tie rod are coupled. Anchor rods from deadmen or rock bolts are welded to plates having holes for receiving the vertical tie rods to form a rigid interlocked structure.

BRIEF DESCRIPTION OF THE DRAWINGS

In the drawings which illustrate preferred embodiments of the invention.

DETAILED DESCRIPTION OF THE PREFERRED EMBODIMENT

Figure 1:
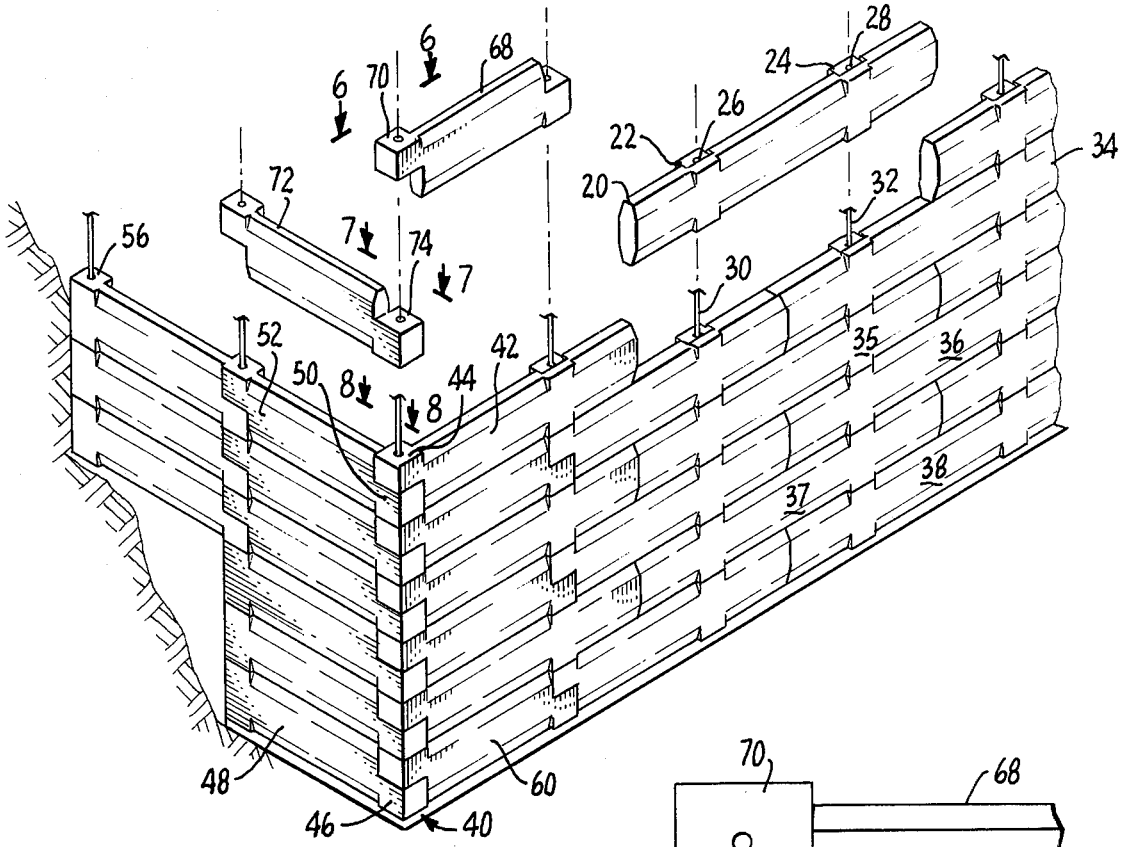
FIG. 1 is a perspective view illustrating an assembled portion of the front face, end wall, and corner of a retaining wall structure using the stretchers of the invention.

FIG. 1 is a perspective view illustrating the construction of a retaining wall face, end wall and corner using stretchers designated as full stretchers, one-third stretchers, and one-half stretchers. The full stretcher 20 is a reinforced concrete unit having a generally elongated octagonal cross-section, and in the preferred embodiment, has the dimensions of 12½ feet in length, slightly less than 2 feet in height, and 8 inches in width. Cast together with the stretcher 20 are support heads 22 and 24, each of which contains a centrally located vertical hole 26 and 28 of 2½ inches in diameter. Support heads 22 and 24 preferably have a dimension of 1 foot wide, 2 feet high, and 10 inches in width. In the preferred embodiment, the spacing between the vertical holes 26 and 28 is 6¼ feet; therefore, the spacing between all vertical tie rods, such as rods 30 and 32, is similarly equal to 6¼ feet, as in the spacing between all vertical holes in all the supporting heads of all the stretchers in the retaining wall structure.

The distance between hole 26 or 28 and the adjacent outboard end of the full stretcher 20, is one-half the spacing between holes 26 and 28 or $3\frac{1}{8}$ feet. A full stretcher is designed with this overhang so that a retaining wall face can be assembled by staggering adjacent courses of full stretchers, as shown by staggered stretchers 34, 35, 36, 37 and 38.

While staggered courses of stretchers provide excellent strength characteristics, they are not particularly suited to the construction of end walls and cannot conveniently be brought to a solid reinforced corner, such as corner 40 in FIG. 1. Therefore, coupled between the end of full stretcher 20 and the corner 40 is a "right-hand" stretcher 42. Right-hand stretcher 42 is similar to the full stretcher 20 except that the lower half of the left support head 44 and its adjacent overhang has been eliminated. Therefore, right-hand stretcher 44 comprises the upper half of one support head 44 together with the full central body, a full support head and overhang of a full stretcher 20. As will be subsequently described in connection with FIG. 4, a right-hand stretcher is approximately 10 feet long and terminates in an upper half-head 44 having a dimension of 1 foot high, 1 foot long and 10 inches deep. As in the case of all other support heads, half-head 44 is provided with a $2\frac{1}{2}$ inch diameter hole for a vertical tie rod.

The upper half-head 44 of a right-hand stretcher 42 forms a corner when mated with a lower half-head, such as head 50 of the one-third stretcher 52.

Figure 2:
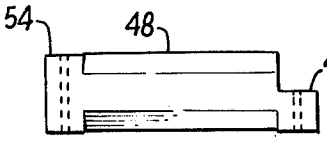
FIG. 2 is an elevation view illustrating the detail of the one-half stretcher.

FIG. 2 is a detailed elevation view of a one-half stretcher, such as stretcher 48. The overall length of one-half stretcher 48 is $7\frac{1}{4}$ feet. A lower half support head 46 is at one end of the stretcher and a full support head 54 is at the opposite end. Both heads 46 and 54 are provided with the usual $2\frac{1}{2}$ inches diameter vertical holes spaced the standard $6\frac{1}{4}$ feet to receive the vertical tie rods. As shown in FIG. 1, a one-half stretcher, such as stretcher 48, is particularly useful in the construction of end walls, or where it is desired to extend a wall from a stretcher having an upper half-head to a wall end, such as the end in FIG. 1.

Figure 3:
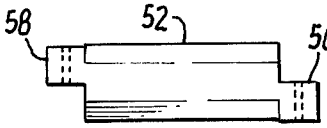
FIG. 3 is an elevation view illustrating the detail of the one-third stretcher.

FIG. 3 is a detailed elevation of a one-third stretcher, such as stretcher 52 in FIG. 1. One-third stretcher 52 is provided with a lower half-head 50 at one end and an upper half-head 58 at the opposite end. Head 58 of one-third stretcher 52 is 1 foot high, 1 foot long, and 10 inches wide. Lower half-head 50, on the other hand, is 1 foot high, 10 inches long, and 1 foot wide. The reason for this difference in dimensions is that lower half-head 50 of the one-third stretcher 52 forms a corner 40 and the width dimension of head 50 should correspond to the length dimension of one foot of the mating upper half-head which, in FIG. 1, is head 44 of the right-hand stretcher 42. If a one-third stretcher is to be used on the front face of the retaining wall, such as the one-third stretcher 60, then both half-heads of that stretcher will have a dimension of 1 foot high, 1 foot long, and 10 inches wide.

Figure 4:
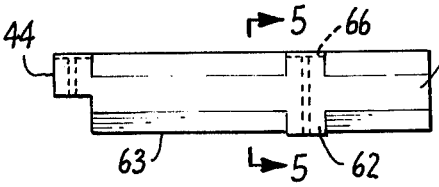
FIG. 4 is an elevation view illustrating the detail of a right-hand stretcher.

FIG. 4 is a detailed elevation view of a right-hand stretcher, such as stretcher 42 of FIG. 1. Right-hand stretcher 42 is provided with an upper half support head 44 at the left end and a conventional full support head 62 and adjacent overhang portion similar to that of the full stretcher 20. The half-head 44 and full support head 62 have the usual $2\frac{1}{2}$ inch diameter vertical holes spaced-apart by the $6\frac{1}{4}$ foot standard to receive the vertical tie rods.

The right-hand stretcher 42 of FIG. 4 has been described as having an upper half support head 44 at the left end. Where it is desired to form a front face corner or an end wall of the right end of the retaining wall of FIG. 1, a mirror image of the right-hand stretcher, or "left-hand stretcher" is used, as will be apparent to those skilled in the art.

Figure 5:
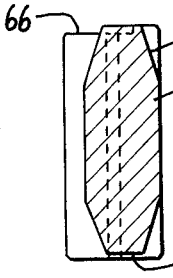
FIG. 5 is a sectional elevation view taken along the plane designated by line 5—5 in FIG. 4 and illustrates a cross-section of a right-hand stretcher.
Figure 10:
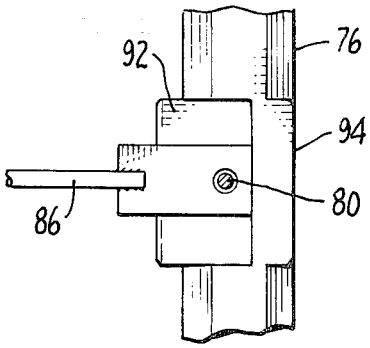
FIG. 10 is a detailed plan view taken along the plane designated by line 10—10 in FIG. 9B and illustrates the connection of an anchor rod to a vertical tie rod.

FIG. 5 is a cross-section view, taken along the plane designated by line 5—5 in FIG. 4 of the right-hand stretcher 42. It should be noted that the dimensions of this cross-section is also applicable to the full stretcher 20. As previously indicated the retaining portions of the stretchers have generally elongated octagonal cross-section that is slightly less than 2 feet in height. In the preferred embodiment, the height of the web or retaining section 64 is $\frac{1}{2}$ inch less than the height of the full support head 62. As illustrated in FIG. 4, the bottom surface of head 62 extends approximately $\frac{1}{2}$ inch below the bottom surface 63 of the retaining section 64 to provide the necessary seepage vents to the retaining wall structure. The thickness of the retaining section 64 is preferably approximately 8 inches and that of the support head is 10 inches. It will be noted that the top surface of the support head 62 is provided with a $\frac{1}{2}$ recess 66 over approximately two-thirds the width of the head. This recess is provided on the top of the heads of all full stretchers and right-hand stretchers to permit the connection of anchor rods, as will be subsequently explained in connection with FIG. 10.

Figure 6:
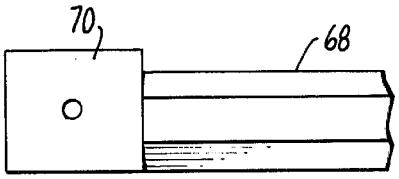
FIG. 6 is a plan view taken along the plane designated by line 6—6 in FIG. 1 and illustrates a corner using a one-third stretcher.
Figure 7:
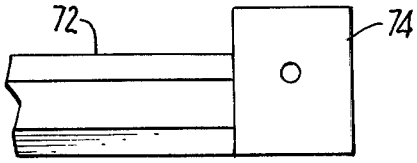
FIG. 7 is a plan view taken along the plane designated by line 7—7 in FIG. 1 and illustrates a corner using a one-third stretcher of different dimensions.

FIG. 6 is a plan view taken along the plane designated by line 6—6 in FIG. 1 and illustrates the configuration of the end of a one-third stretcher 68 in the front face of the retaining wall of FIG. 1. As previously indicated in connection with the description of FIG. 3, a one-third stretcher in the front face of the retaining wall has an upper half-head 70 that is 1 foot high, 1 foot long along the length of the wall, and 10 inches wide. On the other hand, a one-third stretcher in the side wall, such as stretcher 72 of FIG. 1, must have a lower half-head 74 that is twelve inches wide to match the mating upper half-head 70 on the stretcher in the front face of the wall. FIG. 6 is a plan view of a one-third stretcher 68 and its upper half-head 70 in the front face of the wall of FIG. 1, whereas FIG. 7 is a plan view of a one-third stretcher 72 and its lower half-head 74 in the end wall of the structure of FIG. 1.

Figure 8:
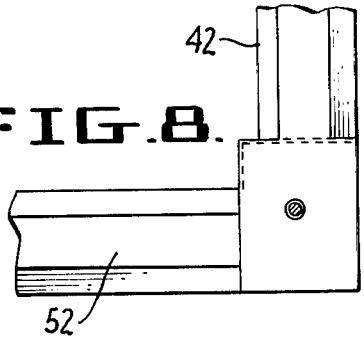
FIG. 8 is a plan view taken along the plane designated by line 8—8 in FIG. 1 and illustrates a corner in which the end head of a right-hand stretcher overlies that of a one-third stretcher.

FIG. 8, which is a plan view taken along the plane designated by line 8—8 in FIG. 1, shows the interconnection of the one-third stretcher 52 in the end wall and the right-hand stretcher 42 in the front face of the retaining wall of FIG. 1. It can be seen from FIG. 8 that the widths of the supporting heads in the end wall should correspond to the lengths of the supporting heads in the front face of the wall.

FIG. 9 contains four perspective views illustrating portions of the front face of a retaining wall at various depths from the top of the wall structure to the footing. Thus, FIG. 9A is a perspective view illustrating portions of the wall near the top surface where staggered full-stretchers 76 and 78 are shown interlocked by vertical tie rods 80 and 82. Deadman 84 is shown coupled by anchor rod 86 to the vertical tie rod extending through the top surfaces of the left support heads of stretcher 76. Deadman 84 and rod 86 overlies fill material retained by a conventional mat 88 which is merely set in appropriate places and need not be connected to the anchor rod 86, the vertical tie rods 80 or 82, or the stretchers 76 or 78. Plates 89 are threadably received on the upper ends of the tie rods 80 above the uppermost course of stretchers to secure the stacked courses of stretchers against vertical separation relative to one another.

Figure 9A:
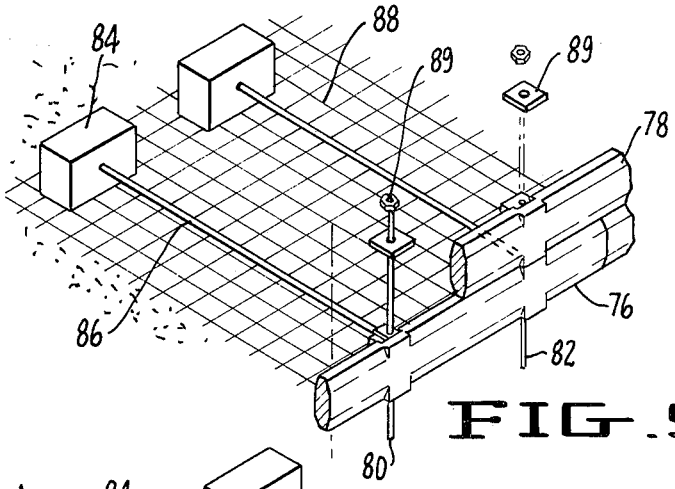
FIGS. 9A through 9D are perspective views illustrating a partial retaining wall face with various anchoring structures.
Figure 9B:
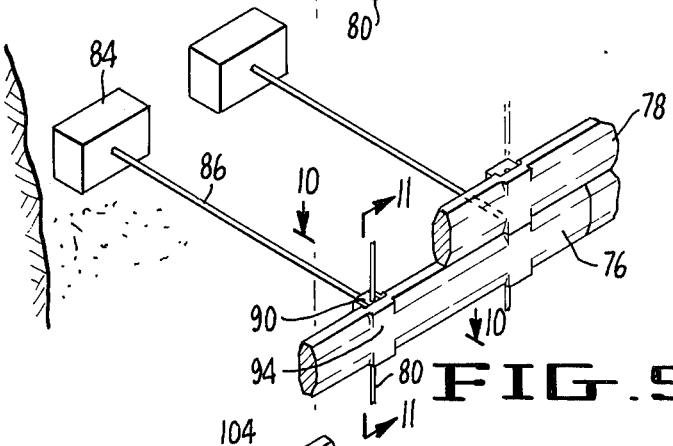
Figure 11:
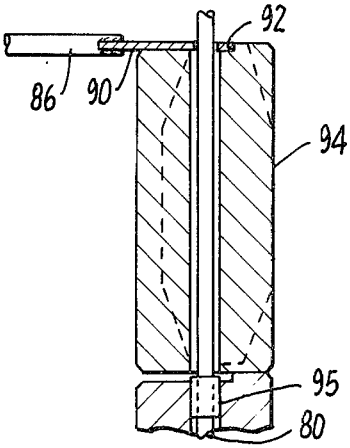
FIG. 11 is a detailed sectional elevation view taken along the plane designated by line 11—11 in FIG. 9B and illustrates the connection of an anchor rod to a vertical tie rod.

FIG. 9B is a perspective view illustrating the same section illustrated in FIG. 9A except that mat 88 has been omitted and the connection between the anchor rod 86 and the vertical tie rod 80 is more clearly illustrated. It will be noted that the anchor rod 86 extending from the deadman 84 is welded to an anchor plate 90 which contains a $1\frac{1}{2}$ inch diameter hole and which is placed in the recess 92 in the top surface of the left head 94 of the full stretcher 76. As shown in the detailed views of FIGS. 10 and 11, the anchor plate 90 receives the vertical tie rod 80 which, in the preferred embodiment, is a $1\frac{1}{4}$ inch diameter steel rod 6 feet in length to simplify the stacking of stretchers in the adjacent course. As previously mentioned, and as shown in FIG. 11, a full length tie rod 80 is made up of one or more 6-foot lengths connected together by a threaded coupling 95.

Figure 9C:
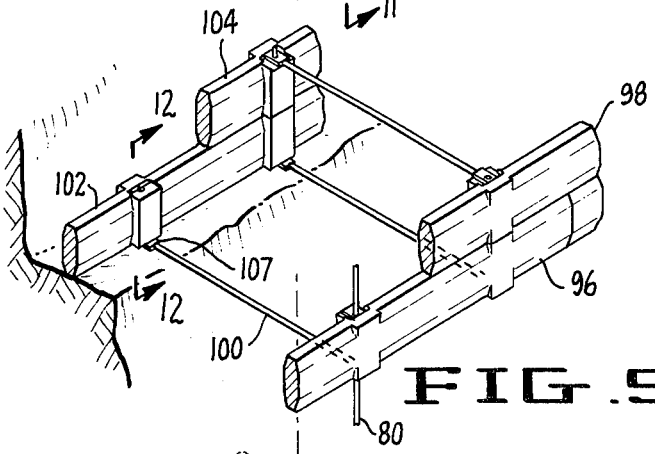
Figure 12:
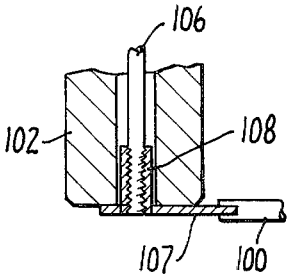
FIG. 12 is a partial elevation view taken along the plane designated by line 12—12 in FIG. 9C and illustrates the connection of an anchor rod to the vertical tie rod in a double or bin wall anchorage.

FIG. 9C is a perspective view of a portion of the front face of the retaining wall in which the full stretchers 96 and 98 are supported by anchor rods 100 that are connected to a bin wall anchorage comprised of a second wall of full-stretchers embedded within the foundation material. As in the case of a front face retaining wall, the bin wall structure is comprised of a plurality of staggered courses of full-stretchers 102, 104 interlocked by their own vertical tie rod 106. Anchor rod 100, which is coupled to the vertical tie rod 80 in the front face of the wall is coupled to the bin wall through an anchor plate 107 as shown in the detailed view of FIG. 12. Welded to anchor plate 107 is an internally threaded coupling 108 having an outside diameter of approximately $2\frac{3}{8}$ inches and an inside bore that is threaded to receive the threaded end of the vertical tie rod 106.

Figure 9D:
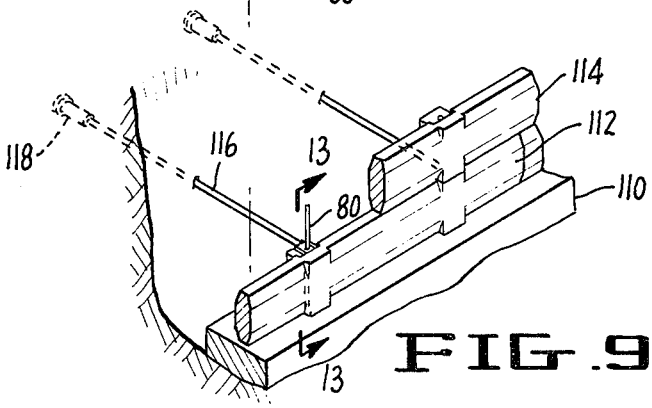
Figure 13:
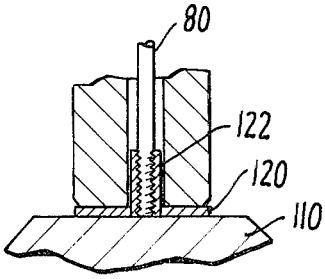
FIG. 13 is a partial elevation view taken along the plane designated by line 13—13 in FIG. 9D illustrating the connection of a vertical tie rod to a wall footing.

FIG. 9D is a perspective view of a portion of the front face retaining wall including a portion of the concrete footing 110, a full stretcher 112 in the first course of stretchers and a portion of the stretcher 114 in the second course. In FIG. 9D, anchor rod 116 is shown connected into a rock bolt anchorage 118 which is secured within a hole in the rock foundation material in the usual manner. The anchor rod 116 is connected to the vertical tie rod 80 extending through the head of the stretchers 112 in the same manner as is illustrated and described in connection with FIGS. 10 and 11. As more clearly shown in the detailed cross-section view in FIG. 13, footing 110 has a flat top surface upon which is placed a steel footing plate 120, to which is welded a plurality of steel couplings, such as steel coupling 122 that is internally threaded to receive the threaded lower end of the vertical tie rod 80. Because the assembled retaining wall is interlocked with vertical tie rods spaced every $6\frac{1}{4}$ feet, and since each tie rod is anchored to rock bolts or deadmen every 4 feet vertically as shown in FIG. 9C, the wall is secure from horizontal movement. Therefore, footing plate 120 is not anchored to the footing 110 but merely lies on its flat top surface.

Although a preferred embodiment has been illustrated and described, it should be understood that the invention is not intended to be limited to the specifics of this embodiment, but rather is defined by the accompanying claims.

What is claimed is:

1. A retaining structure comprising: a plurality of courses of preformed stretchers having an elongated body with integral first and second support heads, said heads being spaced apart a predetermined fixed distance and having generally flat upper and lower stacking surfaces, the vertical depth of said heads as measured between the upper and lower surfaces thereof being greater than the vertical depth of the length of the stretcher disposed between said support heads, each of said heads having a vertical tie rod hole generally centrally located in said head for receiving a tie rod; and vertically extending tie rods secured to the lowermost course of stretchers and extending upwardly therefrom through the holes in the courses of stretchers thereabove.

2. The structure claimed in claim 1 wherein said stretchers have lengths of substantially twice the fixed spacing between said vertical tie rod holes, the distance between one of said tie rod holes and the adjacent end of said stringer being substantially one-half said fixed spacing.

3. The structure claimed in claim 1 wherein the tie rods extend through and are secured to the uppermost course of stretchers, whereby the rods secure the courses against vertical separation relative to one another.

4. A retaining structure comprising: a plurality of courses of preformed stretchers, having an elongated body with integral first and second support heads, said heads being spaced apart a predetermined fixed distance and having generally flat upper and lower stacking surfaces, each of said heads having a vertical tie rod hole generally centrally located in said head for receiving a tie rod, said stretchers having a length of substantially twice the fixed spacing between said vertical tie rod holes, the distance between one of said tie rod holes and the adjacent end of said stretcher being substantially one-half said fixed spacing, the upper flat surface of said first and second support heads containing recesses parallel to said upper surfaces and extending through said vertical tie rod holes for receiving anchor rod plates; vertically extending tie rods secured to the lowermost course of stretchers and extending upwardly therefrom through the holes in the courses of stretchers thereabove; anchor plates received in said recesses, said plates each having a hole therein engaged around the tie rod extending through the recess within which the plate is received; and anchor rods secured to and extending from the anchor plates.

5. The structure claimed in claim 4 wherein said stretcher support head has a vertical dimension greater than the vertical dimension of said elongated body so that a seepage space is provided between stacked courses of stretchers.

6. A retaining structure comprising: a plurality of courses of preformed stretchers having an elongated body with integral first and second support heads, said heads being spaced apart a predetermined fixed distance and having generally flat upper and lower stacking surfaces, said first head being at a terminal end of the stretcher and having a vertical dimension that is approximately one-half the vertical dimension of the second head, each of said heads having a vertical tie rod hole generally centrally located in said head for receiving a tie rod; and vertically extending tie rods secured to the lowermost course of stretchers and extending upwardly therefrom through the holes in the courses of stretchers thereabove.

7. A retaining structure comprising: a plurality of courses of preformed stretchers having an elongated body with integral first and second support heads at the terminal ends thereof, said first head having a vertical dimension that is approximately one-half the vertical dimension of the second head and said heads being spaced apart a predetermined fixed distance and having generally flat upper and lower stacking surfaces, each of said heads having a vertical tie rod hole generally centrally located in said head for receiving a tie rod; and vertically extending tie rods secured to the lowermost course of stretchers and extending upwardly therefrom through the holes in the courses of stretchers thereabove.

8. A retaining structure comprising: a plurality of courses of preformed stretchers having an elongated body with integral first and second support heads at the terminal ends thereof, said heads being spaced apart a predetermined fixed distance and having generally flat upper and lower stacking surfaces, said first and second ends having vertical dimensions that are substantially one-half the vertical dimension of the body, the upper stacking surface of the first head being substantially flush with the top surface of the body and the lower stacking surface of the second head being substantially flush with the bottom of the body, each of said heads having a vertical tie rod hole generally centrally located in said head for receiving a tie rod; and vertically extending tie rods secured to the lowermost course of stretchers and extending upwardly therefrom through the holes in the courses of stretchers thereabove.

9. A retaining structure comprising: a plurality of courses of preformed stretchers having an elongated body with integral first and second support heads, said heads being spaced apart a predetermined fixed distance and having generally flat upper and lower stacking surfaces, each of said heads having a vertical tie rod hole generally centrally located in said head for receiving a tie rod; a footing disposed beneath the lowermost course of stretchers; a footing plate interposed between the top surface of the footing and said lowermost course of stretchers, said footing plate having integral therewith a plurality of tie rod couplings at positions along the length of the plate that coincide with the vertical tie rod holes in the first and second support heads; and vertically extending tie rods secured to the tie rod couplings and extending upwardly therefrom through the holes thereabove in the stretchers.

10. The structure claimed in claim 9 wherein said vertical tie rod is threaded to mating threads in the couplings in said footing plate, said tie rod having a length equal to the approximate height of three courses of stretchers, said tie rod being threaded on its upper end for coupling to the lower end of a second vertical tie rod.

11. A retaining structure comprising: a plurality of courses of preformed stretchers having an elongated body with integral first and second support heads, said heads being spaced apart a predetermined fixed distance and having generally flat upper and lower stacking surfaces, each of said heads having a vertical tie rod hole generally centrally located in said head for receiving a tie rod; vertically extending tie rods secured to the lowermost course of stretchers and extending upwardly therefrom through the holes in the courses of stretchers thereabove; and plates interposed between the support heads of at least some of the adjacent courses of stretchers, said plates having apertures therein received around the tie rods and having anchor rods secured thereto and extending laterally from one side of the stretchers.

12. The structure claimed in claim 11 further comprising deadman anchors secured to the ends of said anchor rods remote from the stretchers.

13. The structure claimed in claim 11 further comprising a bin wall anchorage secured to the ends of said anchor rods remote from the stretchers.

14. The structure claimed in claim 13 wherein the bin wall anchorage is comprised of courses of stretchers corresponding generally to those of the retaining structure courses and tie rods extending through stretchers of the bin wall and are secured to the anchor rods.

15. The structure claimed in claim 11 further comprising rock anchors secured to the ends of said anchor rods remote from the stretchers.

* * * * *